United States Patent [19]

Asbell et al.

[11] 4,134,088

[45] Jan. 9, 1979

[54] MINIATURE MAGNETIC MERCURY-WETTED RELAY CONSTRUCTION

[75] Inventors: Walter E. Asbell, Westerville; James M. Benjamin, Columbus, both of Ohio; Anthony Tedeschi, Raytown, Mo.; Michael P. VanDerWielen, Andover, Mass.; Larry L. Wiese, Pickerington, Ohio

[73] Assignees: Western Electric Company, New York, N.Y.; Bell Telephone Laboratories, Incorporated, Murry Hill, N.J.

[21] Appl. No.: 793,123

[22] Filed: May 2, 1977

[51] Int. Cl.[2] ..... H01H 29/00

[52] U.S. Cl. ..... 335/51; 335/58; 335/55

[58] Field of Search ..... 335/49, 51, 55, 57, 335/58, 274, 276, 236, 154

[56] References Cited

U.S. PATENT DOCUMENTS 3,440,583 4/1969 Woodhead ..... 335/154

3,579,158 5/1971 Kutyla ..... 335/55 X

*Primary Examiner*—George Harris

*Attorney, Agent, or Firm*—William H. Kamstra

[57] ABSTRACT

A miniature magnetic, mercury-wetted relay construction for achieving optimum magnetic reluctance in its operating flux path and thereby improving relay sensitivity. The dimensions of the armature of the relay are determined for maximum flux-carrying capacity without sacrifice of flexibility by mounting the armature to the relay stem by means of a thin, magnetic hinge. At the pole-piece end of the relay, a recess is provided within which the contact is mounted, the recess forming a flux concentrator projection of the pole-piece which extends outwardly therefrom toward the opposing face of the armature. Reluctance of the flux closure path is further reduced by providing an integral extension of the stem toward the end of the pole-piece which extension advantageously acts as a parallel flux path shunting the small gap presented at the armature end and an end of the stem. By forming the shunt extension integrally with the stem, joint reluctance is eliminated.

9 Claims, 1 Drawing Figure

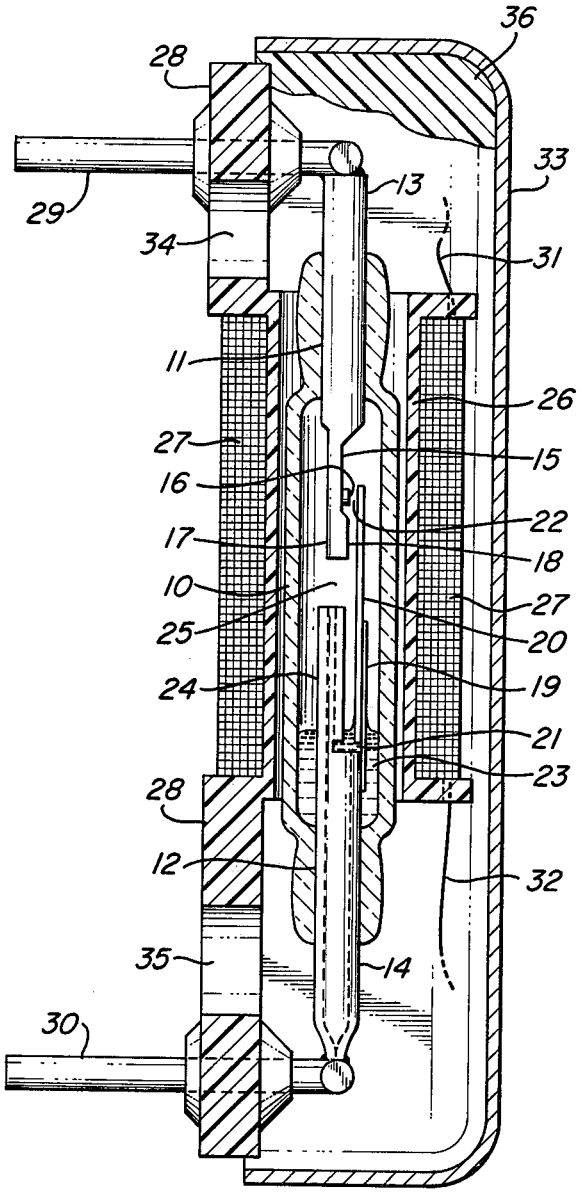
36
28
33
13
29
34
31
11
26
27
15
16
22
17
18
10
27
25
20
24
19
21
23
28
12
32
35
14
30

MINIATURE MAGNETIC MERCURY-WETTED RELAY CONSTRUCTION

BACKGROUND OF THE INVENTION

This invention relates to electromagnetically actuated electrical switches and more particularly to such switches having contact elements sealed in an enclosing envelope.

Sealed contact switches are well known in the electrical arts and have long found extensive application in electrical systems for performing a wide range of switching functions. A typical dry reed form of such switches comprises a pair of overlapping reed springs of a magnetically responsive and electrically conductive material suspended at their ends by an envelope, usually glass, in which they are sealed. A winding encircling the envelope is energizable to generate a magnetic field for actuating the reed springs to control the electrical circuit in which the switch may be connected. Such dry reed switches have served well in particular circuit applications; however, the character of their contact surfaces renders them essentially current limited. Minute imperfections on the contact surfaces reduce the areas of electrical connection to less than the entire surface of the contact. As a result, current of a magnitude beyond a predetermined limit tend to cause melting at the contact areas, which, in turn, increases the tendency of contacts to stick closed after actuation. To counteract this tendency, greater reed spring retractile forces are required which increases the amount of magnetic flux and coil current required to operate the switch.

Where larger current carrying capacities are required, this problem has been largely overcome by the employment of the well-known mercury-wetted relay. Typically, the surfaces of the opposing contacts of this form of sealed relay are coated with a film of mercury. When these surfaces meet upon energization of the relay, electrical connection is uniformly established over the entire contact surfaces. As a result, the magnitude of the currents carried by the relay required to cause contact surface melting is greatly increased. As a further and important result, the current values necessary to actuate the relay are substantially reduced. Since the force required to separate the contacts need not contend with contact melting, the stiffness of the armature may be substantially less than that of the dry reed relay counterpart. The lower limit of armature stiffness of a mercury-wetted relay is determined only by the requirement that the armature restoring force be sufficient to overcome the mercury surface forces and hence rupture the mercury bridge between the contacts. This lower armature stiffness therefore allows mercury-wetted switches to require smaller amounts of magnetic flux for their operation than their dry reed counterparts while having substantially improved load switching capability.

This much higher switching capability makes mercury-wetted contacts very useful in conjunction with solid state circuitry to serve as an interface device capable of handling load currents and voltages which would destroy standard semiconductor devices. However, existing mercury-wetted relays suffer from one or both of two deficiencies, namely, that they are either incompatible with standard logic in size or in current and voltage required to operate the relay. The structural geometry is of particular importance when the miniature size of the relay is considered. In order, for example, to provide a relay more compatible in size with current solid state devices, one having overall external dimensions of 1.0 inches in length, 0.300 inches in width, and 0.275 inches in height is contemplated. It will be appreciated that dimensions of this order impose serious constraints on the possible internal structural arrangements of the relay available to reduce flux path reluctance.

It is accordingly an object of this invention to provide a new and novel miniature mercury-wetted relay construction offering a greater operate sensitivity and higher dielectric and load switching capabilities than hitherto possible in a size compatible with current solid state devices.

Another object of this invention is the reduction of magnetic flux return path reluctance in a miniature mercury-wetted relay.

SUMMARY OF INVENTION

The foregoing and other objects of this invention are realized in one specific illustrative embodiment thereof comprising a relay in which a magnetic stem member and a magnetic pole-piece member extend substantially coaxially into a conventional glass envelope at its opposite ends. The members are also electrically conductive and form the two external terminals of the switch as they extend externally from the envelope at either end. The pole-piece member presents a flat surface having a recess formed therein inwardly from its internal end in which recess an electrical contact of the relay is mounted. At the opposite end of the switch, the stem member has affixed thereto a flexible magnetic hinge, which hinge, in turn, suspends from its under surface the armature member of the switch. The latter member extends from its hinged attachment to the stem member into overlapping and spaced-apart association with the pole-piece electrical contact.

It will be appreciated that the armature member could have been mounted directly on the stem surface. Such a mounting arrangement, however, would largely contravene the sensitivity advantage of the relay. The required cross-sectional dimensions of the armature member as a primary flux path would reduce the flexibility of the armature at its hinge area thereby adding to the current values required for its actuation. Thus, according to one feature of a mercury-wetted relay of this invention, by providing a flexible, low reluctance hinge for the armature, advantageously, no flux-carrying capacity need be sacrificed. Further, since the hinge assumes the function of providing armature flexibility, the armature itself may be shortened without the concern of adding to its rigidity.

At the contact end of the armature member, another feature of this invention provides for a more effective coupling of magnetic flux between the pole-piece member and the armature. As mentioned in the foregoing, the pole-piece contact is mounted thereon well back from the pole-piece end. Additionally, the contact is set in a recess formed in the pole-piece. The recess forms in the extension of the pole-piece, a portion which projects upwardly toward the lower armature surface. This projecting portion, also flattened, presents a surface substantially coplanar with the contact surface. In its unoperated state, the armature is thus suspended substantially equidistant from both the contact and the projecting surface. As an actuating external magnetic field is applied, the pole-piece projection effective acts to concentrate flux between the pole-piece and armature, thereby enhancing its tractile force and reducing flux path reluctance. Importantly, the angle of deflection of the armature prevents any contact of this pole-piece projection and the armature, the latter making electrical connection only with the wetted contact surface.

Still another feature of a relay construction according to this invention is a magnetic shunt for further reducing flux return path reluctance. At the stem of the switch (on which the armature hinge is mounted), an extension thereof presents a second flattened surface stepped down from the hinge mounting surface. This second surface lies substantially parallel to the underside of the armature, the extension projecting along the longitudinal axes of the stem and pole-piece and well toward the end face of the latter. Since some reluctance is introduced by the gap presented at the armature and stem ends, the extension, being an integral part of the stem, provides an effective parallel path for the operative magnetic flux shunting the hinge gap.

BRIEF DESCRIPTION OF THE DRAWING

The foregoing and other objects and features of a miniature mercury-wetted relay construction according to the principles of this invention will be better understood from a consideration of the detailed description of the organization and operation of one specific illustrative embodiment thereof which follows when taken in conjunction with the single FIGURE of the accompanying drawing which shows in lengthwise cross-section view the elements making up the relay organization, the view being enlarged to clarify its details.

DETAILED DESCRIPTION

One illustrative relay construction according to this invention is depicted in the single FIGURE of the drawing in which construction the operating elements are conventionally sealed in a glas envelope 10. These elements, which are, in practice, intended for vertical arrangement as shown, comprise an upper pole-piece 11 and a lower stem 12. The elements 11 and 12 are formed of an electrically conductive, magnetically responsive material and extend externally from opposite ends of the envelope 10 to comprise terminal ends 13 and 14, respectively. Pole-piece 11 and stem 12 lie substantially coaxially, and pole-piece 11 is internally formed to present a recess 15 presenting a flattened surface on which an electrical contact 16 is affixed in any suitable manner. Pole-piece 11 extends beyond recess 15 and contact 16 to form a flux concentrator section 17, the recess 15 terminating to form an outwardly extending projection 18, the surface of which is also flattened and substantially coplanar with the surface of contact 16. At the lower end of enveloped 10 as viewed in the drawing, stem 12 provides a mounting surface for a hinge 19 which may be affixed thereto in any suitable manner such as by welding. The hinge 19 extends upwardly and has, in turn, similarly affixed thereto an armature 20. At its hinged end, armature 20 is spaced apart from stem 12, thereby presenting a small gap 21. At its other end, armature 20 overlaps surface 18 and the surface of contact 16 and is spaced apart from the latter surface to present the contact-armature gap 22. Conventionally, the lower portion of envelope 10 comprises a reservoir for the mercury as represented at 23. By capillary action, the entire surfaces of armature 20 and its hinge 19 are mercury coated from reservoir 23. Except for the surface of contact 16, the entire end of pole-piece 11 is rendered non-wettable by mercury through means such as chromeoxide plating thereby preventing any mercury wetting during fabrication or subsequent operation, leaving only the contact surface wetted. The interior of envelope 10 has further sealed therein a suitable gas, such as hydrogen, for preventing oxidation and selected in view of possible breakdown voltages appearing across the open elements of the relay. Armature 20 and its hinge 19 are also of a suitable electrically conductive magnetically responsive material well-known in the art, armature 20 being dimensioned to present a low reluctance path for magnetic flux during the operation of the relay to be considered hereinafter. Hinge 19 also presents a low reluctance path; its dimensions are such, however, that in order to provide sufficient flexibility and thereby armature sensitivity, gap 21 acts as a supplemental, albeit higher, reluctance path for the magnetic flux operating armature 20.

According to one feature of the relay of this invention, a shunt path for the operative flux is provided lying parallel to the primary flux path of armature 20. Stem 12 is provided with an extension 24 projecting along its longitudinal axis toward the opposing face of pole-piece 11. The side of extension 24 opposite the facing surface of armature 20 is flattened as a stepdown surface from the surface mounting hinge 19. Extension 24 of stem 12 projects well along the length of armature 20 without, however, approaching pole-piece 11 sufficiently close to interfere with flux closure between the concentrator section 17 and armature 20. Extension 24 thus presents a flux path shunting the higher reluctance path across gap 21.

Conventionally, one of the elements 11 and 12 (here stem 12) is hollow to permit access to the interior of envelope 10 for the introduction of mercury and the enclosed gas. Continuing with a description of the other aspects of the miniature mercury-wetted relay of this invention, it is understood that the switch structure enclosed in envelope 10 is in turn enclosed in a bobbin 26 about which an energizing winding 27 is wound. The effective total magnetic circuit reluctance depends on the switch dimensions, the specific geometry of winding 27, the location of the switch with respect winding 27, and the shape and location of permeable magnetic cover 33. The exceptionally high sensitivity and low power dissipation of this relay have resulted from the combined optimization of switch characteristics and an optimal design of the relay winding 27 dimensions, coil location with respect to the switch, and magnetic coupling of the switch to permeable relay cover 33 which serves to reduce further the return path reluctance and to act as a magnetic shield. Bobbin 26 is formed of a suitable electrically insulating material which has formed integrally therewith a base 28 for the relay housing. Base 28 has provided at each end a pair of terminals, terminals 29 and 30 of each pair of which are shown in the drawing. Terminals 29 and 30 extend through base 28 and are electrically connected as by soldering, for example, to the terminals ends 13 and 14, respectively, of pole-piece 11 and stem 12. In view of the section view of the drawing assumed along the centerline of the relay structure, only the rearward (as viewed in the drawing) terminals 29 and 30 are shown. Two corresponding terminals, not shown, will, accordingly, be understood as being connected to the two terminations 31 and 32 of the energizing winding 27. Finally, an enclosure 33 for encasing the structure so far described is provided which is appropriately adapted to fit about and fasten to the base 28. A pair of apertures 34 and 35 provide access to the interior of enclosure 33 for the introduction, for example, of a potting compound 36, a portion of which is represented in the drawing. As is known, enclosure 33 is also formed of a magnetic material and may act to some extent as a path for flux closure during the operation of the relay.

With the foregoing organization of an illustrative mercury-wetted relay according to this invention in mind, an exemplary operation thereof may now be described. In the drawing, relay armature 20 is shown in its normally unoperated state thereby presenting a substantially equal gap between its under end surface and the surfaces of contact 16 and surface 18 of flux concentrator projection 17. Upon the application of an energizing current to winding 27 via terminals of the relay, not shown, and winding ends 31 and 32, a magnetic field is conventionally generated which may be assumed as passing through envelope 10 in an upwardly direction as viewed in the drawing. This field, in finding a closure path, follows that of least reluctance which may be traced through the switch elements as follows: beginning at the stem 12, hinge 19 and hinge gap 21, between armature 20 and one step end of stem 12, armature 20, the gap between the latter under surface and surface 18 of flux concentrator section 17, the latter section proper, and pole-piece 11. Some flux will also close from the undersurface of armature 20 through the last-mentioned air gap and contact 16 and some leakage flux will close from the end of armature 20. Leakage flux may also find closure paths through magnetic enclosure 33.

The flexibility of hinge 19 permits the cross-sectional dimensions of armature 20 to be determined for its maximum flux-carrying capacity and thereby its lowest reluctance, as mentioned hereinbefore. The concentration of flux at flux concentrator extension 17 ensures that the maximum tractile force on armature 20 is exerted by the generated field. To compensate for the reluctance introduced at hinge gap 21, shunt extension 24 provides a flux closure path parallel to armature 20. Flux thus shunted from hinge gap 21 closes through the gap existing between extension 24 and armature 20 and augments the flux in the latter element. Advantageously, because extension 24 is an integral part of stem 12, no joint reluctance is presented to affect the sensitivity of the relay.

As the end of armature 20 closes on contact 16, an electrical connection is there made through the now merged mercury coatings of each contacting element. When the energizing current being applied to winding 27 is terminated, armature 20 is withdrawn from contact 16 as the result of the restoring spring action of hinge 19. As armature 20 retracts, a mercury bridge between it and contact 16 is momentarily formed, which bridge is ruptured to break the electrical connection as is known.

What has been described is considered to be only one specific illustrative embodiment of a miniature mercury-wetted relay construction according to the principles of this invention. Accordingly, it is to be understood that various and numerous other arrangements may be devised by one skilled in the art without departing from the spirit and scope of the invention as limited only as defined in the accompanying claims.

What is claimed is:

1. A miniature magnetically responsive, mercury-wetted relay construction comprising a magnetic stem member, a magnetic pole-piece member, means for oppositely supporting said stem and pole-piece members, armature means, a magnetic hinge for flexibly mounting said armature means on said stem member to extend over an overlap portion of said pole-piece member, said overlap portion having a recess formed therein to present a surface opposite one face of said armature means, an electrical contact mounted on said pole-piece member on said recess surface spaced apart from said opposite one face of said armature means, and flux concentrator means for concentrating magnetic flux between said pole-piece member and said armature means comprising a projection of said pole-piece member at said overlap portion formed by said recess, said projection extending from said pole-piece member toward said one face of said armature means.

2. A miniature magnetically responsive, mercury-wetted relay construction as claimed in claim 1 also comprising magnetic shunt means comprising an integral extension of said stem member toward said pole-piece member presenting a surface substantially parallel to said one face of said armature means.

3. A miniature magnetically responsive, mercury-wetted relay construction as claimed in claim 2 also comprising winding means associated with said construction energizable for generating a magnetic field for actuating said armature means.

4. A miniature magnetically responsive, mercury-wetted relay construction comprising a magnetic stem member, a magnetic pole-piece member, means for oppositely supporting said stem and pole-piece members, armature means, a magnetic hinge for flexibly mounting said armature means on said stem member to extend over an overlap portion of said pole-piece member, one end of said armature member presenting a small gap with the end of said stem member, said overlap portion having a recess formed therein to present a surface opposite one face of said armature means, an electrical contact mounted on said pole-piece member on said recess surface spaced apart from said opposite one face of said armature means, flux concentrator means for concentrating magnetic flux between said pole-piece member and said armature means comprising a projection of said pole-piece member at said overlap portion formed by said recess, said projection extending from said pole-piece member toward said one face of said armature means, and magnetic shunt means comprising an integral extension of said stem member beyond said end toward said pole-piece member bypassing said gap and presenting a surface substantially parallel to said one face of said armature means.

5. In a magnetic, mercury-wetted relay construction having oppositely mounted pole-piece and stem members and an armature member extending from said stem member to said pole-piece member, a low reluctance operating flux path comprising a thin, magnetic hinge for flexibly mounting said armature member to said stem member and a flux concentrator extension of said pole-piece member extending outwardly from a contact-bearing surface of said pole-piece member toward an opposing face of said armature member.

6. In a relay construction as claimed in claim 5, said operating flux path further comprising a magnetic shunt member integral with and extending from said stem member parallel with said armature member and toward said pole-piece member.

7. In a magnetic, mercury-wetted relay construction having oppositely mounted pole-piece and stem members and an armature member extending from said stem member to said pole-piece member, a low reluctance operating flux path comprising a thin, magnetic hinge for flexibly mounting said armature member to said stem member a magnetic shunt member integral with and extending from said stem member parallel with said armature member and toward said pole-piece member, and a flux concentrator extension of said pole-piece member extending outwardly from a surface of said pole-piece member toward an opposing face of said armature member.

8. A miniature magnetically responsive mercury-wetted relay comprising an elongated envelope, an electrically conductive rigid magnetic stem member extending into said envelope at one end thereof, an electrically conductive rigid magnetic pole-piece member extending into said envelope at the other end thereof and opposite said stem member, a magnetic armature extending in said envelope from said stem member to adjacent said pole-piece member and overlapping said pole-piece member, and a magnetic spring hinge flexibly mounting said armature on said stem member, said pole-piece member having a flat surface facing said armature, a contact mounted on said surface for making electrical contact with said armature and a raised flux concentrating portion at the inner end thereof removed from said envelope, said raised flux concentrating portion having a flat surface substantially coplanar with the surface of said contact.

9. A miniature magnetically responsive mercury-wetted relay in accordance with claim 8 further comprising mercury within said envelope and a plating on said pole-piece member for preventing mercury wetting of said pole-piece member except for said surface of said contact opposite said armature.

* * * * *